US008714679B2

(12) United States Patent
Kuno

(10) Patent No.: US 8,714,679 B2
(45) Date of Patent: May 6, 2014

(54) PRINT CONTROL DEVICE SETTING DIRECTION OF MAIN SCANNING

(75) Inventor: Masashi Kuno, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 127 days.

(21) Appl. No.: 13/362,566

(22) Filed: Jan. 31, 2012

(65) Prior Publication Data

US 2012/0213569 A1 Aug. 23, 2012

(30) Foreign Application Priority Data

Feb. 18, 2011 (JP) ..... 2011-033547

(51) Int. Cl.
*B41J 29/38* (2006.01)
*B41J 11/44* (2006.01)

(52) U.S. Cl.
USPC ..... 347/14; 347/9; 347/43; 347/15; 347/19

(58) Field of Classification Search
CPC ..... B41J 11/44
USPC ..... 347/5, 14, 15, 19, 43
See application file for complete search history.

(56) References Cited

U.S. PATENT DOCUMENTS

| | | | | |
|---|---|---|---|---|
| 6,474,779 | B2 * | 11/2002 | Inui et al. | 347/43 |
| 6,517,192 | B2 * | 2/2003 | Kaneko et al. | 347/43 |
| 6,669,319 | B2 * | 12/2003 | Shimizu | 347/15 |
| 6,669,331 | B2 * | 12/2003 | Teshigawara et al. | 347/43 |
| 8,152,261 | B2 * | 4/2012 | Furuichi et al. | 347/5 |
| 8,303,068 | B2 * | 11/2012 | Ikeda et al. | 347/14 |
| 2001/0024218 | A1 | 9/2001 | Inui et al. | |
| 2002/0158942 | A1 | 10/2002 | Kaneko et al. | |
| 2002/0171709 | A1 | 11/2002 | Teshigawara et al. | |

FOREIGN PATENT DOCUMENTS

| | | | |
|---|---|---|---|
| JP | 2000-190470 | A | 7/2000 |
| JP | 2001-180017 | A | 7/2001 |
| JP | 2001-180018 | A | 7/2001 |
| JP | 2002-248798 | A | 9/2002 |
| JP | 2003-034021 | A | 2/2003 |
| JP | 2003-305838 | A | 10/2003 |
| JP | 2004-050705 | A | 2/2004 |
| JP | 2008-132666 | A | 6/2008 |
| JP | 2009-051099 | A | 3/2009 |

OTHER PUBLICATIONS

Japan Patent Office, Office Action for Japanese Patent Application No. 2011-033547 (counterpart Japanese patent application), mailed Feb. 5, 2013.

* cited by examiner

*Primary Examiner* — Manish S Shah
*Assistant Examiner* — Jeremy Delozier
(74) *Attorney, Agent, or Firm* — Baker Botts L.L.P.

(57) ABSTRACT

A print control device includes a processor operating as a determining unit and a direction setting unit. The determining unit determines that a condition is satisfied for a boundary block when an index value of the boundary block indicates that an estimated amount is larger than a first value, and that the condition is satisfied for an internal block when an index value of the internal block indicates that the estimated amount is larger than a second value. The second value is larger than the first value. The direction setting unit sets, for each part data, a direction of main scanning to a specific direction when the part data includes the block that satisfies the condition. The direction setting unit sets the direction of main scanning to a direction opposite to a previously set direction when the part data does not include the block that satisfies the condition.

17 Claims, 10 Drawing Sheets

PRINT CONTROL DEVICE SETTING DIRECTION OF MAIN SCANNING

CROSS REFERENCE TO RELATED APPLICATION

This application claims priority from Japanese Patent Application No. 2011-033547 filed Feb. 18, 2011. The entire content of the priority application is incorporated herein by reference.

TECHNICAL FIELD

The invention relates to an image process technique for generating print data.

BACKGROUND

There is conventionally known an ink-jet type printer that scans a print head having a plurality of nozzle arrays corresponding to a plurality of colors for ejecting ink droplets in the main scanning direction perpendicular to the nozzle array and, at the same time, ejects ink droplets from the nozzle array onto a paper sheet, thereby printing an image onto the paper sheet.

A printer of such a type can print an image corresponding to a band-like print area (band) that is a unit area for printing and has the same width as the nozzle width (length of the nozzle array) in a single main scan of the print head. To print an image onto an area wider than a single band (e.g., a sheet of paper), band-by-band image print operation is repeated while the position of a paper sheet is shifted in the sub-scanning direction.

Further, a printer of such a type performs bidirectional printing in which the print head is moved in both a first main scanning direction and a second main scanning direction, thereby increasing print speed as compared to one directional printing in which the print head is moved only in one main direction. However, an overlapping order of a plurality of colors of inks on a print medium is different between the printing in the first main scanning direction of the print head and the printing in the second main scanning direction thereof, so that color banding may occur due to difference in color development of a printed image. That is, there may be a case where images of the same color in image data are viewed as images of different colors in the printed image.

In order to cope with the above problem, there is known a print method that determines for each partial image data corresponding to the band whether there is any image in which the difference in color development is easily noticeable and determines the direction of the main scan. Specifically, in this print method, the number of dots (recording duty) in a predetermined size window is counted while the window is shifted in the partial image data. When there is detected any window in which the counted value is not less than a threshold value, print operation (one directional printing) in the same main scanning direction as the previous main scanning direction is performed. When there is detected no window in which the counted value is not less than a threshold value, print operation (bidirectional printing) in the opposite main scanning direction to the previous main scanning direction is performed.

SUMMARY

A color difference (separate color difference) between two images separated away from each other is less noticeable when compared to a color difference (adjacent color difference) between two adjacent images. Thus, even if two images in different bands exist such that the difference in color development is noticeable, the difference in color development in bidirectional printing is less noticeable when the two images are separated from each other than when the two images are adjacent to each other. However, in conventional print methods, no consideration has been given to the utilization of the property in which the separate color difference is less noticeable than adjacent color difference for increasing the frequency of the bidirectional printing.

The invention has been made in view of the above problem, and an object thereof is to increase the frequency of the bidirectional printing.

In order to attain the above and other objects, the invention provides a print control device. The print control device includes a processor configured to control a print execution unit to print an image on a recording sheet while a main scanning in which a print head moves in one of a first main scanning direction and a second main scanning direction opposite to the first main scanning direction. The print head ejects ink droplets of a plurality of colors to overlap one on the other in a first order on the recording sheet while the main scanning in which the print head moves in the first direction whereas the print head ejects ink droplets of the plurality of colors to overlap one on the other in a second order different from the first order on the recording sheet while the main scanning in which the print head moves in the second main scanning direction. The processor is configured to operate as a block setting unit, a determining unit, and a direction setting unit. The block setting unit is configured to set a plurality of blocks for each of a plurality of part data included in image data. Each part data corresponds to a unit region on a recording sheet. The unit region is to be printed while the main scanning is performed once. Each block includes a plurality of pixels. The determining unit is configured to determine, for each block included in the part data, whether a specific condition for printing the part data including the each block in a specific direction is satisfied based on an index value of the each block relating to an estimated amount of ink that is to be used. The direction setting unit is configured to set, for each part data, a direction of the main scanning to the specific direction when it is determined that the part data includes the block that satisfies the specific condition whereas the direction setting unit is configured to set the direction of the main scanning to an opposite direction opposite to a previously set direction of the main scanning when it is determined that the part data does not include the block that satisfies the specific condition. The plurality of blocks includes a boundary block representing an image located adjacent a boundary of the unit region and an internal block representing an image located apart from the boundary of the unit region. The determining unit is configured to determine that the specific condition is satisfied for the boundary block when the index value of the boundary block indicates that the estimated amount is larger than a first value. The determining unit is configured to determine that the specific condition is satisfied for the internal block when the index value of the internal block indicates that the estimated amount is larger than a second value. The second value is larger than the first value.

According to another aspect, the present invention provides a non-transitory computer readable storage medium storing a set of program instructions installed on and executed by a computer. The program instructions are configured to control a print execution unit to print an image on a recording sheet while a main scanning in which a print head moves in one of a first main scanning direction and a second main scanning direction opposite to the first main scanning direction. The print head ejects ink droplets of a plurality of colors to overlap one on the other in a first order on the recording sheet while the main scanning in which the print head moves in the first direction whereas the print head ejects ink droplets of the plurality of colors to overlap one on the other in a second order different from the first order on the recording sheet while the main scanning in which the print head moves in the second main scanning direction. The program instructions includes: (a) setting a plurality of blocks for each of a plurality of part data included in image data, where each part data corresponds to a unit region on a recording sheet, where the unit region is to be printed while the main scanning is performed once, and where each block includes a plurality of pixels; (b) determining, for each block included in the part data, whether a specific condition for printing the part data including the each block in a specific direction is satisfied based on an index value of the each block relating to an estimated amount of ink that is to be used; and (c) setting, for each part data, a direction of the main scanning to the specific direction when the determining instruction (b) determines that the part data includes the block that satisfies the specific condition whereas the setting instruction (d) sets the direction of the main scanning to an opposite direction opposite to a previously set direction of the main scanning when the determining instruction (b) determines that the part data does not include the block that satisfies the specific condition. The plurality of blocks includes a boundary block located adjacent a boundary of the unit region and an internal block located apart from the boundary of the unit region. The determining instruction (b) determines that the specific condition is satisfied for the boundary block when the index value of the boundary block indicates that the estimated amount is larger than a first value. The determining instruction (b) determines that the specific condition is satisfied for the internal block when the index value of the internal block indicates that the estimated amount is larger than a second value. The second value is larger than the first value.

DETAILED DESCRIPTION

<1. First Embodiment>

<1-1. Configuration>

Figure 1:
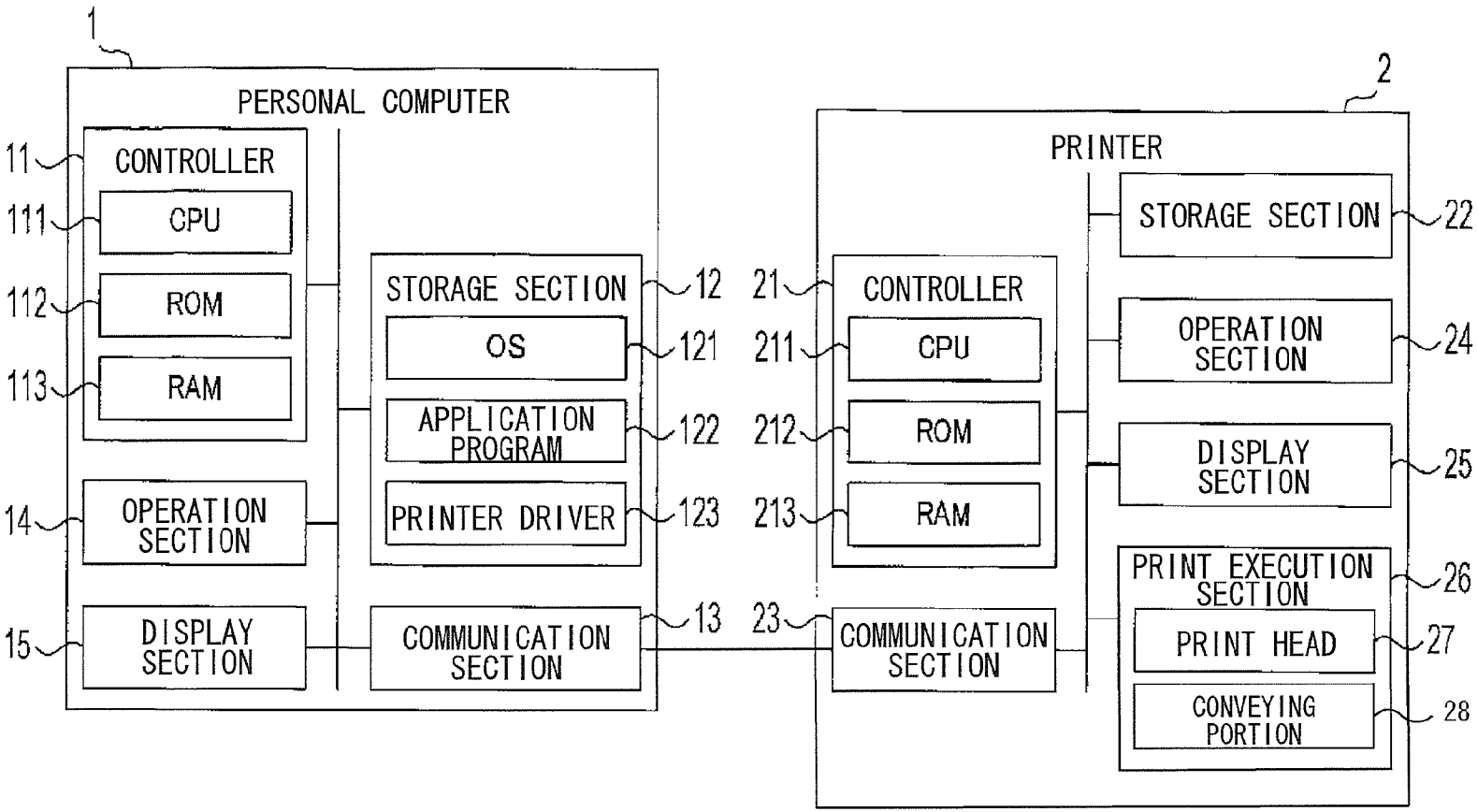
FIG. 1 is a block diagram schematically illustrating a configuration of a print system according to a first embodiment.

FIG. 1 is a block diagram schematically illustrating a configuration of a print system according to a first embodiment. The print system includes a personal computer 1 and a printer 2 configured to be able to perform data communication with each other.

The personal computer 1 is a general-purpose information processor and includes a controller 11, a storage section 12, a communication section 13, an operation section 14, and a display section 15.

The controller 11 overall-controls respective components of the personal computer 1 and includes a CPU 111, a ROM 112, and a RAM 113. The storage section 12 is a non-volatile storage device that can rewrite its stored data. In the first embodiment, a hard disk drive is used as the storage section 12. An operating system (OS) 121, an application program 122 such as a graphic tool, and a printer driver 123 which is software (program) for allowing the personal computer 1 to utilize the printer 2 are installed in the storage section 12. The communication section 13 is an interface for performing data communication with the printer 2. The operation section 14 is an input device for a user to input a command. In the first embodiment, a keyboard or a pointing device (mouse, touchpad, etc.) is used as the operation section 14. The display section 15 is an output device for displaying various information as a user-viewable image. In the embodiment, a liquid crystal display is used as the display section 15.

The printer 2 is an ink jet type printer and includes a controller 21, a storage section 22, a communication section 23, an operation section 24, a display section 25, and a print execution section 26.

The controller 21 overall-controls respective components of the printer 2 and includes a CPU 211, a ROM 212, and a RAM 213. The storage section 22 is a non-volatile storage device that can rewrite its stored data. In the embodiment, a flash memory is used as the storage section 22. The storage section 22 stores a program for controlling the controller 21 to perform a print control process described later. The communication section 23 is an interface for performing data communication with the personal computer 1. The operation section 24 is an input device for a user to input a command and is provided with various operation buttons. The display section 25 is an output device for displaying various information as a user-viewable image. A small liquid crystal display is used as the display section 25.

Figure 2A:
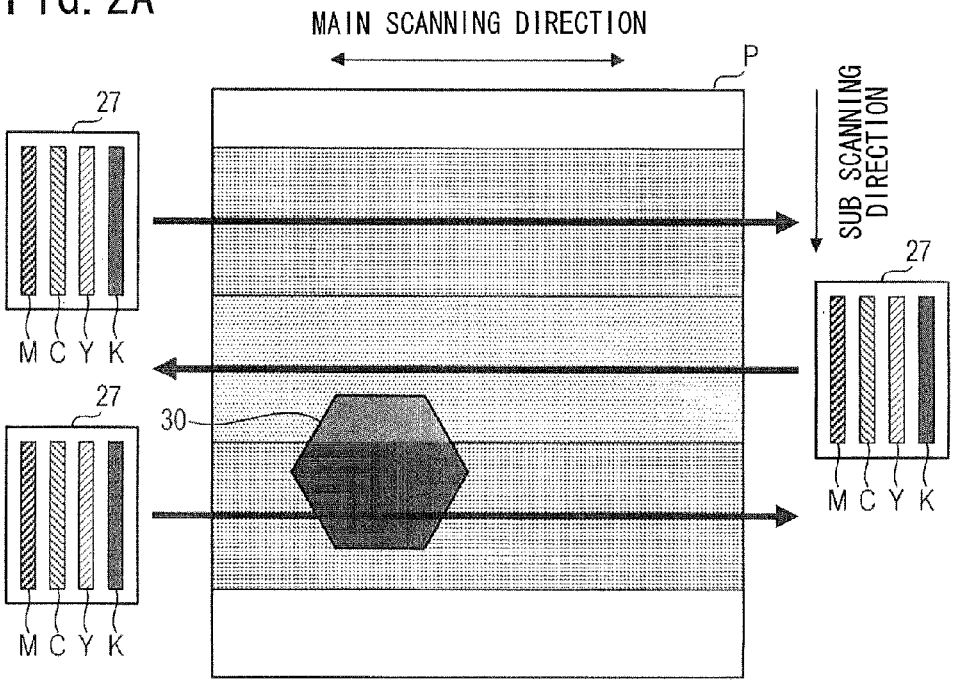
FIG. 2A is an explanatory diagram illustrating a printed image in which an object is located over two bands.
Figure 2B:
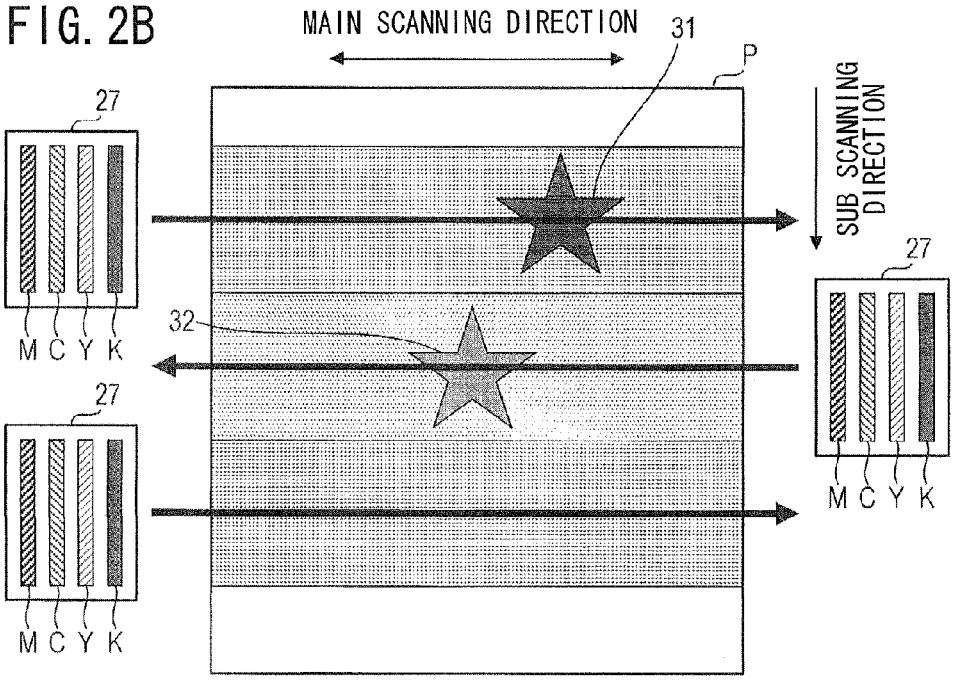
FIG. 2B is an explanatory diagram illustrating a printed image in which two objects are located on two bands and is apart from each other.
Figure 3:
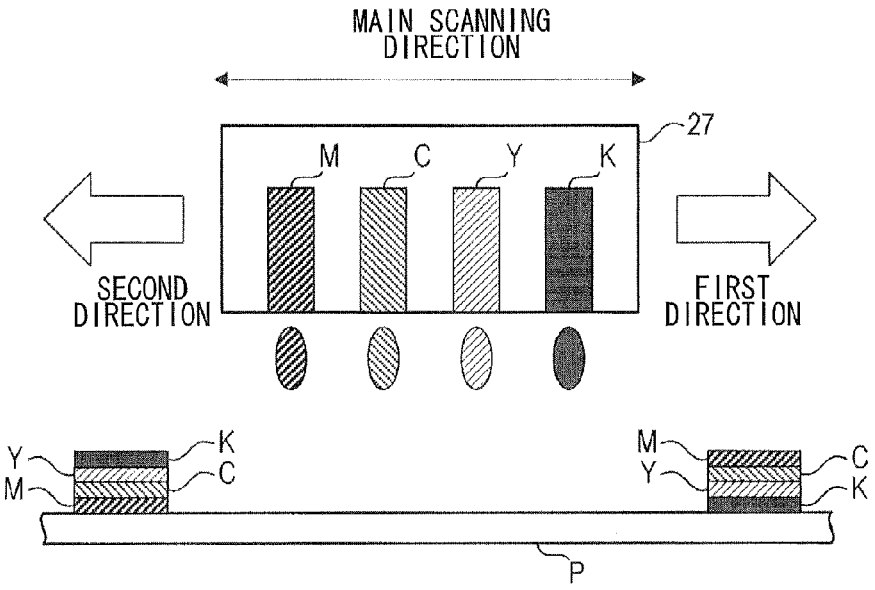
FIG. 3 is an explanatory diagram illustrating orders of ink droplets on a recording sheet.

The print execution section 26 includes a print head 27 and a conveying portion 28 conveying paper sheet P in a sub-scanning direction. As shown in FIGS. 2A, 2B, and 3, the print head 27 can reciprocate in the direction (main scanning direction) perpendicular to the conveyance direction (sub-scanning direction) of a paper sheet P as a print medium. The print head 27 prints an image onto the paper sheet by ejecting ink droplets based on print data during reciprocation of the print head 27 based on print data while alternately performing the main scan of the print head 27 and the conveyance of the paper sheet P in the sub-scanning direction. Nozzles for ejecting ink droplets of respective colors of cyan (C), magenta (M), yellow (Y), and black (K) are arranged in an array on the lower surface (surface facing the paper sheet) of the print head 27 along the sub-scanning direction, and four nozzle arrays are formed as a whole. The print head 27 can adjust an amount of ejecting ink to one of a plurality of levels, thereby expressing four gradation levels (large dot, medium dot, small dot, and no dot).

In the printer 2 according to the embodiment, dye inks are used for C, M, and Y (chromatic color), respectively, and a pigment ink is used for K (achromatic color). The dye ink easily permeates into fibers of the paper sheet P. The pigment ink is hard to permeate into the inside of the paper sheet P but fixed to the paper surface, and thus the pigment ink is poor in fixing performance to a gloss paper sheet while superior in sharpness of characters with respect to a regular paper sheet.

<1-2. Outline of Processing>

The outline of processing executed in the print system according to the first embodiment will be described. In the personal computer 1, print start operation is executed in the running application program 122, and the printer driver 123 is activated. Upon activation of the printer driver 123, the controller 11 of the personal computer 1 transfers image data expressed in RGB values of 256 gradation levels (8-bit range from 0 to 255) expressing an image to be printed to the printer 2.

Figure 4:
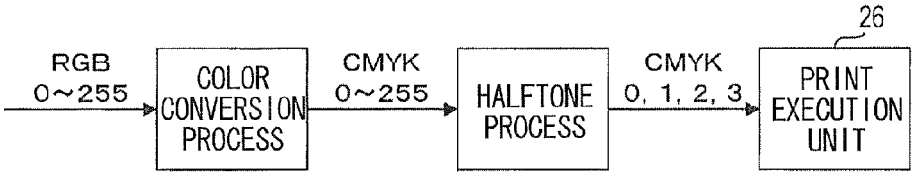
FIG. 4 is an explanatory diagram illustrating image process performed on a printer.

As shown in FIG. 4, upon reception of the image data from the personal computer 1, the controller 21 of the printer 2 performs color conversion process to convert the received image data expressed in the RGB values of 256 gradation levels into image data expressed in CMYK values of 256 gradation levels. Then, the controller 21 performs halftone process (e.g., error diffusion process) for the image data after the color conversion process to generate image data (dot data) expressed in CMYK values of four gradation levels that can be expressed by the print head 27 as print data. The controller 21 then outputs the generated print data to the print execution section 26. The print execution section 26 then performs printing of an image onto the paper sheet P based on the print data.

As shown in FIG. 3, the printer 2 can perform bidirectional printing in which the print head 27 is moved in both a first main scanning direction and a second main scanning direction. The bidirectional printing allows achievement of an increase in the printing speed as compared to one directional printing in which the print head 27 is moved only in one main scanning direction. On the other hand, the bidirectional printing may make the color banding due to difference in color development of a printed image easily noticeable. Such color banding is made especially noticeable when the bidirectional printing is performed with one-pass printing in which the paper sheet P is conveyed by the nozzle width for each main scan (one pass) of the print head 27 to complete printing of an image of a predetermined area in a single main scan (one pass).

That is, as shown in FIG. 3, in the print head 27, the four nozzle arrays corresponding to the CMYK color inks are arranged in the order of magenta (M), cyan (C), yellow (Y), and black (K) in the main scanning direction. In the case where printing is performed with the print head 27 moved in a first main scanning direction (direction from left to right in FIG. 3), the overlapping order of the CMYK color inks on the paper sheet P is black (K), yellow (Y), cyan (C), and magenta (M) from the bottom (from the paper sheet P side). In the case where printing is performed with the print head 27 moved in a second main scanning direction (direction from right to left in FIG. 3), the overlapping order of the CMYK color inks on the paper sheet P is magenta (M), cyan (C), yellow (Y), and black (K) from the bottom. In the printer 2 of the embodiment, so-called forward direction (direction in which the print head 27 is moved away from its initial position) is referred to as the first direction, and so-called reverse direction (opposite direction to the forward direction) is referred to as the second direction.

As described above, the overlapping order of the CMYK color inks on the paper sheet P is different between the printing in the first main scanning direction of the print head 27 and the printing in the second main scanning direction thereof, which may cause difference in color development of a printed image. That is, there may be a case where images of the same color in image data are viewed as images of different colors in the printed image. Thus, in the bidirectional printing, the ink overlapping order differs for each band (pass) which is a unit print area printed through a single main scan of the print head 27, making the color banding due to difference in color development of a printed image easily noticeable, as shown in FIGS. 2A and 2B.

Figure 5:
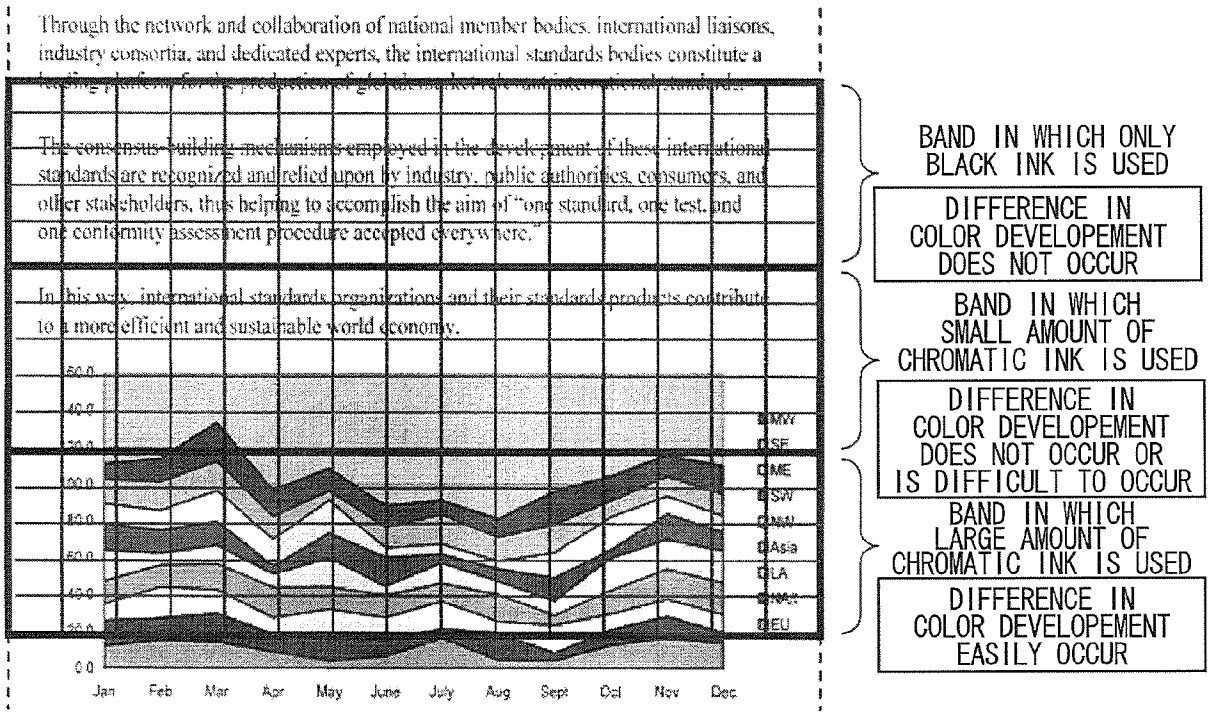
FIG. 5 an explanatory diagram illustrating an example of a printed image.

Such difference in color development tends to be more noticeable in an image printed with larger ink amount. Specifically, as illustrated in FIG. 5, the difference in color development does not occur (or hardly occur) in an image (e.g., image including only black characters) in a band formed with only the black (K) ink or an image in a band formed with chromatic color (CMY) inks but the use amount thereof is small. On the other hand, the difference in color development easily occurs in an image (e.g., image representing a color drawing) in a band formed with a large amount of chromatic color inks.

Figure 6:
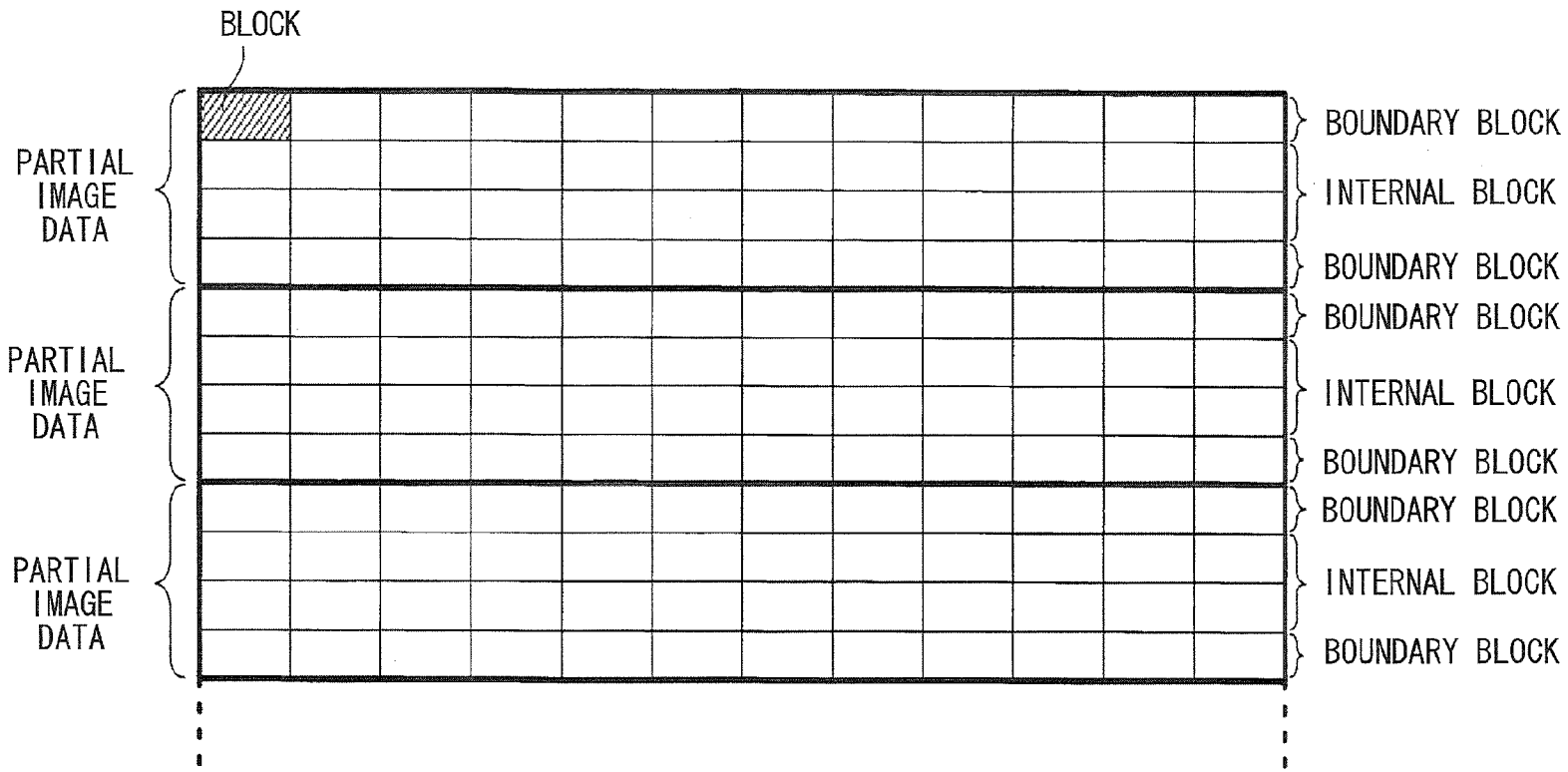
FIG. 6 is an explanatory diagram illustrating a plurality of blocks set by dividing partial image data horizontally and vertically.

Thus, in the embodiment, the partial image data corresponding to the band in the image data to be processed is divided vertically and horizontally into a plurality of blocks each including a plurality of pixels, as illustrated in FIG. 6. Then, an index value concerning the ink amount (estimated ink amount) to be used in printing is calculated for each block, and a block whose index value is larger than a threshold value is determined as a block (hereinafter, referred to as "restriction block") that satisfies a print direction restriction condition for restricting the main scanning direction. For the partial image data including the restriction block, the main scanning direction is set to a specified direction (second direction in the embodiment) irrespective of the previous main scanning direction. For the partial image data not including the restriction block, the main scanning direction is set to the direction (direction in which the bidirectional printing is performed) opposite to the previous main scanning direction. That is, for the partial image data including a block with large estimated ink amount, the main scanning direction is restricted to the second direction so as to make the difference in color development less noticeable. In the embodiment, the size of each block is set to an area of 1 mm to 2 mm square in a printed image based on experimental values of the block sizes where the adjacent color difference or separate color difference is easily noticeable. Note that 47 pixels correspond to about 2 mm in a print resolution of 600 dpi, and 23 pixels correspond to about 2 mm in a print resolution of 300 dpi.

Whether the difference in color development of a printed image is noticeable or not also depends upon a positional relationship between two images whose color development differs from each other. That is, in the case where an object 30 shown in FIG. 2A with a uniform color in image data is arranged across two bands printed through the main scans of different directions, the difference in color development between two images obtained by dividing the object 30 into upper and lower parts at the boundary (joint) between two bands is comparatively noticeable around the boundary. On the other hand, as shown in FIG. 2B, in the case where two same objects 31 and 32 each with a uniform color in image data are arranged entirely in two bands printed through the main scans of different directions, respectively, and spaced apart from each other, the difference in color development between the two images (objects 31 and 32) is comparatively less noticeable. That is, even in the case where the color difference between two images is the same, the separate color difference which is the color difference between two images separated away from each other is less noticeable when compared to the adjacent color difference which is the color difference between two adjacent images (images arranged continuously).

Thus, an image corresponding to a boundary block positioned around the boundary of the partial image data (block including pixels in the raster of the end portion in the sub-scanning direction) among the plurality of blocks shown in FIG. 6 can be adjacent to another image printed through a different main scan, so that not only the separate color difference but also the adjacent color difference needs to be taken into consideration. On the other hand, an image corresponding to an internal block spaced apart from the boundary of the partial image data (block not including pixels in the raster of end portion in the sub-scanning direction) cannot be adjacent to another image printed through a different main scan, so that the adjacent color difference need not be taken into consideration particularly, but only the separate color difference needs to be considered. Thus, in the embodiment, as will be described later, a threshold value for internal block and a threshold value for boundary block are prepared as threshold values for determining whether a target block is the restriction block, and a larger value is set to the threshold value for internal block than to the threshold value for boundary block.

<1-3. Concrete Explanation of Process>

A concrete procedure that the printer 2 takes to achieve the above-described process will be described using a flowchart of FIG. 7.

In S11, the controller 21 performs color conversion process to convert image data that has been received from the personal computer 1 and expressed in RGB values of 256 gradation levels into image data expressed in CMYK values of 256 gradation levels. This color conversion process is performed according to a previously stored look-up table (RGB→CMYK).

Then, in step S12, the controller 21 performs print control process for the image data that has been subjected to the color conversion process. The details of the print control process will be described later.

In step S13, the controller 21 performs halftone process for the image data (image data expressed in CMYK values of 256 gradation levels) that has been subjected to the print control process to generate image data (print data) expressed in CMYK values of four gradation levels that can be expressed by the print head 27.

In step S14, the controller 21 performs print data supply process to output the print data generated by the halftone process to the print execution section 26. The print execution section 26 then performs printing of an image onto a paper sheet based on the print data.

Figure 8:
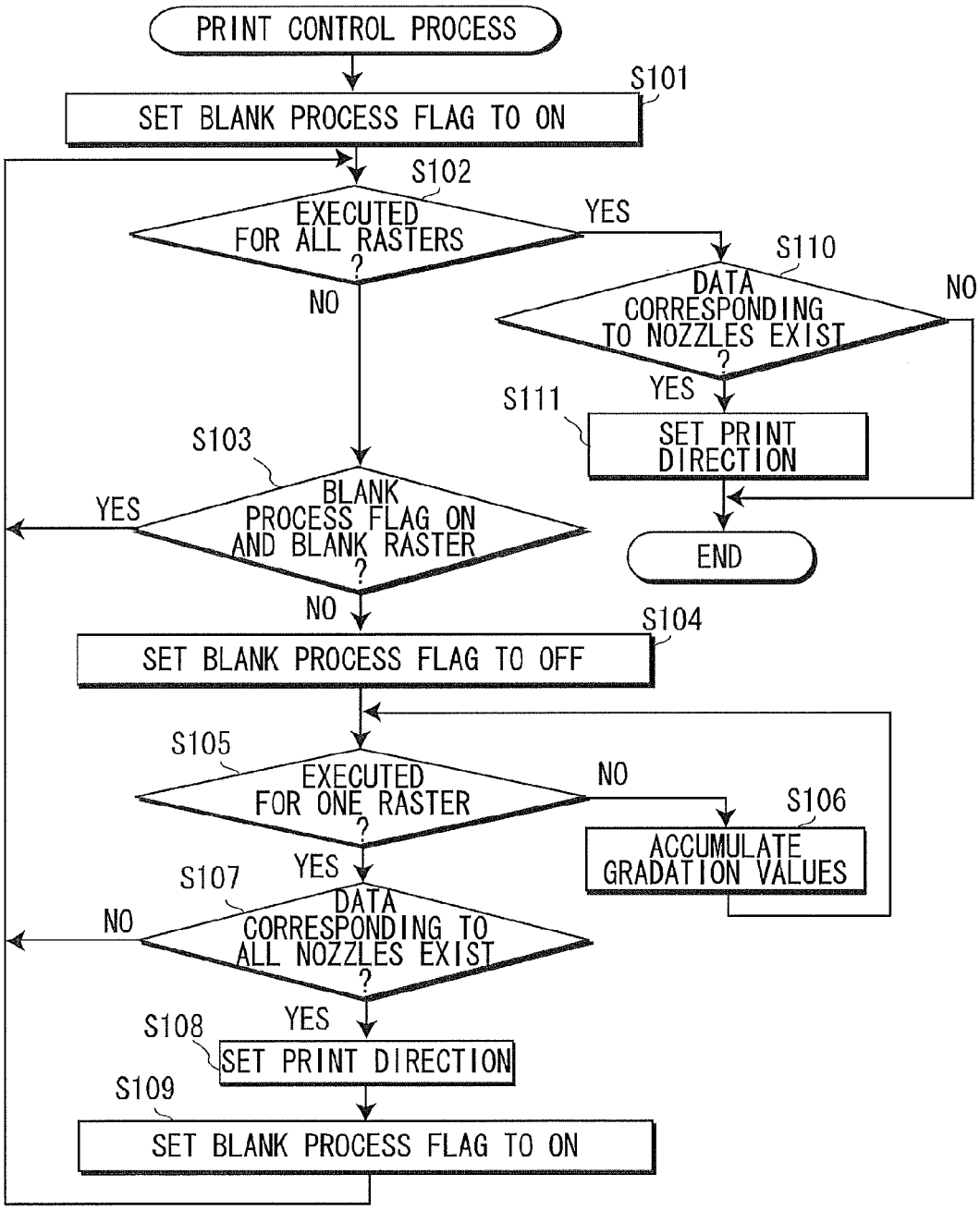
FIG. 8 is a flowchart illustrating a print control process according to a first embodiment.

The above-mentioned print control process executed in S12 will be described in detail. FIG. 8 is a flowchart of the print control process that the controller 21 of the printer 2 executes with respect to image data immediately before being subjected to the halftone process.

In S101, the controller 21 sets a blank process flag as initialization process to ON. The blank process flag is a flag indicating whether blank skipping can be executed. In the blank skipping, if a blank raster exists adjacent to the partial image data in the image data to be printed, printing is performed with a line corresponding to the blank raster skipped. The blank raster is a raster composed of pixels whose CMYK gradation values are all zero (white pixels). That is, in the blank sipping, the paper sheet P is conveyed with the main scan of the print head 27 with respect to the blank raster omitted. If the blank raster exists within the partial image data (the blank raster apart from the boundary of the block), the blank skipping cannot be executed and in such a case, the blank process flag is set to OFF.

Then, in S102, the controller 21 determines whether the process of S103 to S109 to be described later have been performed for all the rasters included in image data corresponding to one page. When the controller 21 determines that there is any unprocessed raster (S102: No), the controller 21 selects one of the unprocessed raster as the raster to be processed and thereafter advances to S103.

Then, in S103, the controller 21 determines whether the blank process flag is ON and whether the raster to be processed is the blank raster. When the controller 21 determines that the blank process flag is OFF or that the raster to be processed is not the blank raster (S103: No), the controller 21 advances to S104.

In S104, the controller 21 sets the blank process flag to OFF. Subsequently, in S105, the controller 21 determines whether the process of S106 to be described later has been performed for all the pixels included in the raster to be processed. When the controller 21 determines that there is any unprocessed pixel in the raster to be processed (S105: No), the controller 21 selects one of the unprocessed pixel as the pixel to be processed (target pixel) and thereafter advances to S106.

In S106, the controller 21 divides vertically and horizontally the partial image data into a plurality of blocks and performs, for each block (FIG. 6), gradation value accumulation for accumulating the total sum of the CMY gradation values of each pixel. Thereafter, the controller 21 returns to S105. The processing of S106 is performed according to the following procedures (1) to (3).

(1) The controller 21 identifies a block to which the target pixel belongs.

(2) The controller 21 determines whether the gradation value of black (K) of the target pixel is not less than a predetermined black determination value. This determination is made for classifying the target pixel into a pixel whose black (K) gradation value is 0 or near 0, or a pixel whose black (K) gradation value is neither 0 nor near 0. The reason for this classification is that color difference in the black (K) ink, especially the pigment ink, due to the ink overlapping order is easily noticeable. Therefore, the black determination value is set to a value near 0. Specifically, patterns (a plurality of types of patterns with different black gradation values) with varying amounts of CMYK inks are actually printed, and the occurrence state of the color banding (specifically, gradation value of black at which the color banding is easily noticeable) is visually confirmed, whereby the black determination value can experimentally be set. In a case like the embodiment where the dye ink is used as the CMY inks and pigment ink is used as the K ink, the black determination value is set to a value of about 3% to 6% of the maximum gradation value (255).

(3) To accumulate the total sum of the CMY gradation values of each pixel in the block, first and second counters are prepared for each block. The first counter is for pixels whose black (K) gradation value is less than the black determination value and second counter is for pixels whose black (K) gradation value is greater than or equal to the black determination value. That is, the number of counters to be prepared is double the number of blocks (2× block number). Data of the count values are stored in the RAM 213. For calculating the accumulated value, the total sum of the gradation values of color components (CMY) corresponding to chromatic color inks constituting each pixel in the block is added to one of the two counters according to the gradation value of the black (K). Specifically, when in the above (2) determination, the gradation value of the black (K) is less than the black determination value, the total sum of the CMY gradation values of the target pixel is added to the count value of the first counter. On the other hand, when in the determination (2), the gradation value of the black (K) is greater than or equal to the black determination value, the total sum of the CMY gradation values of the target pixel is added to the count value of the second counter.

For example, assume that the black determination value is set to 13. When the gradation values of the pixel to be processed are (C, M, Y, K)=(253, 200, 34, 2), which indicates the gradation value of the black (K) is less than the black determination value (e.g., 13), so the total sum (253+200+34) of the CMY gradation values is added to the count value of the first counter. When the gradation values of the pixel to be processed are (C, M, Y, K)=(253, 10, 42, 34), which indicates the gradation value of the black (K) is greater than or equal to the black determination value (e.g., 13), so the total sum (253+10+42) of the CMY gradation values is added to the count value of the second counter. In place of the first counter, a counter that accumulates the total sum of the CMY gradation values of all the pixels in the block may be used.

When the controller 21 determines that the process of S106 has been performed for all the pixels included in the raster to be processed (there is no unprocessed pixel in the raster to be processed) (S105: Yes), the controller 21 advances to S107 and determines whether data corresponding to all nozzles used in a single main scan (data corresponding to 210 rasters, in the embodiment) have been stored in the RAM 213. That is, the controller 21 deteiinines whether the process for one set (unit) of image data has been completed. When the controller 21 determines that data corresponding to all nozzles have not been stored (S107: No), the controller 21 advances to S102.

On the other hand, when the controller 21 determines that data corresponding to all nozzles have been stored (S107: Yes), the controller 21 advances to S108 and performs print direction setting process to set the direction (present print direction) of the main scan. The process of S108 is performed as the following procedures (1) to (3).

(1) First, as index values concerning the estimated ink amount to be used, the controller 21 calculates for each block a first index value and a second index value according to the following expressions based on the count values of the first and second counters, respectively:

First index value=(count value of first counter+count value of second counter)/(number of pixels in block)

Second index value=(count value of second counter)/(number of pixels in block).

(2) Subsequently, the controller 21 determines whether at least one of the first and second index values is larger than the threshold value for determining whether a target block is the restriction block. That is, the controller 21 determines whether there exists the restriction block in the partial image data. In the embodiment, a threshold value for first index value and a threshold value for second index value are prepared, and each threshold value differs depending on whether a target block is the internal block or the boundary block. That is, the following four threshold values are used. The threshold values for internal block are set to values larger than those for the boundary block.

Threshold value for first index value of boundary block (e.g., 0.177)

Threshold value for second index value of boundary block (e.g., 0.0235)

Threshold value for first index value of internal block (e.g., 0.255)

Threshold value for second index value of internal block (e.g., 0.0403).

(3) When, in the determination in the above (2), none of the index values is larger than corresponding threshold value (there is no restriction block), in other words, when determining that target partial image data is partial image data representing an image in which the color difference due to ink overlapping order is less noticeable, the controller 21 sets the direction (present print direction) of the main scan to the direction opposite to the previous main scanning direction (previous print direction). That is, when the previous main scanning direction is the first direction, the present main scanning direction is set to the second direction, whereas when the previous main scanning direction is the second direction, the present main scanning direction is set to the first direction. On the other hand, when determining that at least one of the above index values is larger than the corresponding threshold (one or more restriction blocks exist), in other words, when determining that target partial image data is partial image data representing an image in which the color difference due to ink overlapping order is easily noticeable, the controller 21 sets the direction of the main scan to the second direction irrespective of the previous main scanning direction. The print execution section 26 executes printing operation with the print head 27 moved in the main scanning direction that has been set.

Subsequently, in S109, the controller 21 sets the blank process flag to ON and thereafter returns to S102.

When the controller 21 determines that the blank process flag is ON and that the raster to be processed is the blank raster (S102: Yes), the controller 21 does not perform the process of S104 to S109 but returns to S102. The blank process flag is set to ON at the start time of the print control process (S101), and after being set to OFF in S104 due to determination that the raster to be processed is not the blank raster, the blank process flag is not set to ON until data corresponding to all nozzles are stored (S109). Thus, in the case where blank line data representing the blank raster exists adjacent to the partial image data within the image data to be printed, process is performed with a line corresponding to the blank line data skipped. In this case, the print execution section 26 conveys the paper sheet P with the main scan of the print head 27 with respect to a line corresponding to the blank line data omitted to execute blank skipping wherein printing is performed with the blank line data skipped (blank skipping).

When the controller 21 determines that the processing of S103 to S109 have been performed for all the rasters included in image data corresponding to one page (there is no unprocessed raster) (S102: Yes), the controller 21 advances to S110. Then, in S110, the controller 21 determines whether data corresponding to a part of all nozzles used in a single main scan have been stored. That is, the controller 21 determines whether residual data (data corresponding to less than 210 rasters) resulting from process of image data corresponding to one page in units of the partial image (210-raster) exist. When the controller 21 determines that data corresponding to some nozzles have not been stored (S110: No), the controller 21 ends the print control process.

On the other hand, when the controller 21 determines that data corresponding to a part of nozzles have been stored (S110: Yes), the controller 21 advances to S111 and performs the print direction setting process (the same processing as S108) to set the direction of the main scan. In the case where two copies or more are printed (printing of the same image onto a plurality of paper sheets P), a result of the print control process for the first copy is applied to the printing of the second and subsequent copies (printing is performed in the same directions as those in the print control process for the first copy), thereby allowing a reduction in the progressing time.

1-4. Effect

As described above, according to the first embodiment, for the partial image data including the restriction block (for example, partial image data representing a color drawing), the main scanning direction for printing is set to the second direction. For the partial image data (for example, partial image data representing an image including only black characters) not including the restriction block, the main scanning direction is set to the direction opposite to the previous main scanning direction. Further, the threshold value for internal block is set to a value larger than the threshold value for boundary block, so that the internal block is unlikely to be determined as the restriction block as compared to the boundary block. Thus, the main scanning direction is unlikely to be restricted to the second direction as compared to a case where the determination of whether the internal block is the restriction block or not is made according to the same criterion, whereby the frequency of the bidirectional printing can be increased while the difference in color development of a printed image is made less noticeable.

Further, in the embodiment, for the partial image data including the restriction block, the main scanning direction is always set to a specified direction (second direction in the embodiment) irrespective of the previous main scanning direction. Therefore, for an image (image with large ink amount) in which the difference in color development of a printed image is easily noticeable, the ink overlapping order is set constant. Thus, also for two images positioned across one or more bands, the occurrence of difference in color development due to the ink overlapping order can be prevented.

Further, in the embodiment, even if the first index value of a given block is not larger than the threshold value for first index value, the block is determined as the restriction block if the second index value thereof is larger than the threshold value for second index value. The reason that this determination is made is that color difference in the black (K) ink, especially the pigment ink, due to the ink overlapping order is easily noticeable. Therefore, the color difference due to the ink overlapping order can be made less noticeable as compared to a case where the determination of whether a target block is the restriction block or not is made irrespective of the magnitude of the gradation value of the black (K).

Further, the index value concerning the estimated ink amount to be used in printing is calculated for each block including a plurality of pixels (e.g., 47×47 pixels), and a block whose index value is larger than a threshold value is determined as the restriction block, which allows determination of whether the bidirectional printing should be prohibited or not in units of a human-perceivable block size.

<2. Second Embodiment>

2-1. Difference from First Embodiment

A second embodiment is similar to the first embodiment but differs therefrom in the details of the print control process. That is, in the first embodiment, common process is executed as the process for setting the main scanning direction irrespective of the previous main scanning direction. In the second embodiment, different process is executed according to the previous main scanning direction.

Hereinafter, descriptions of the features the same as the first embodiment will be omitted.

2-2. Print Control Process

Figure 9:
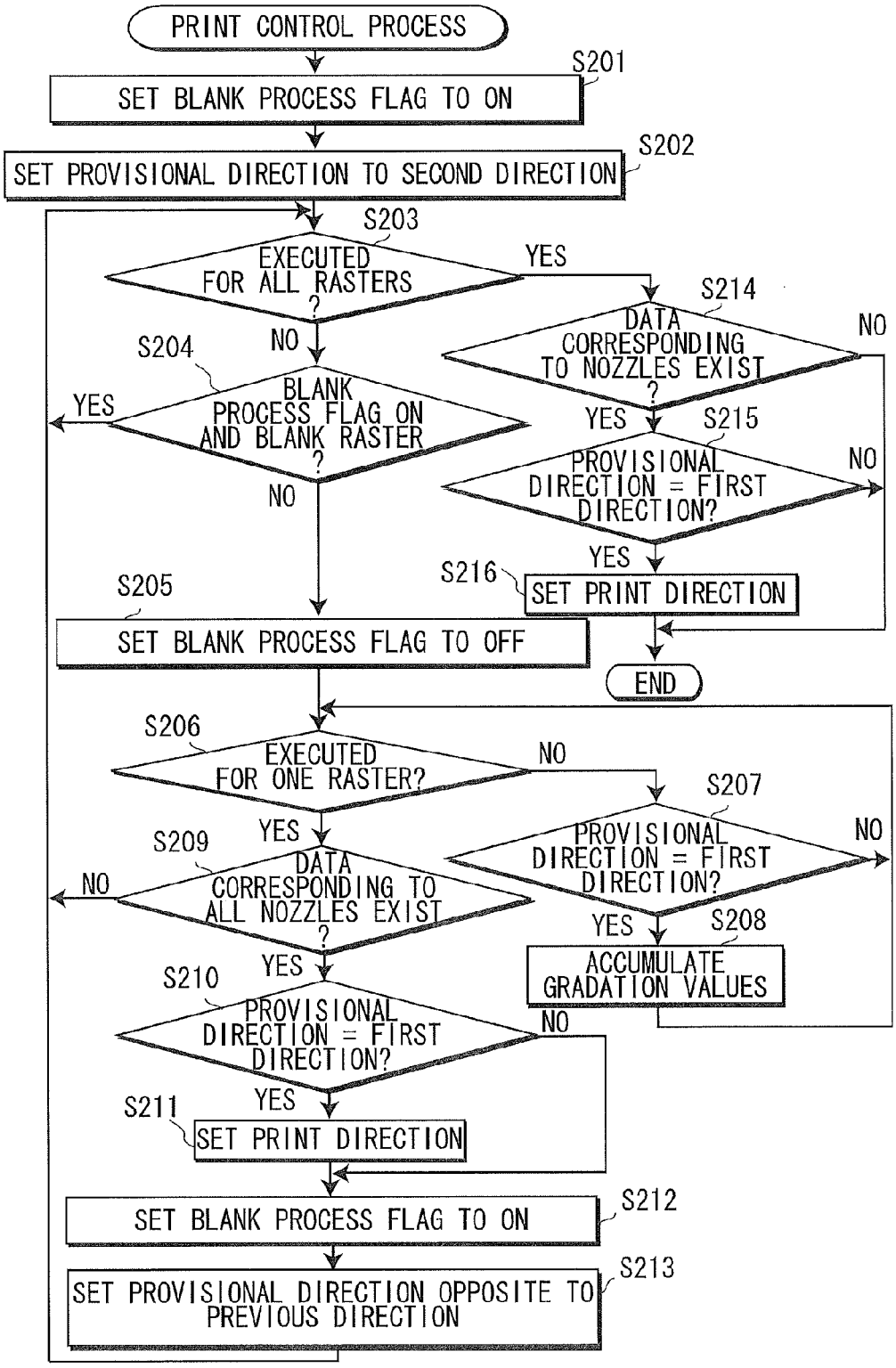
FIG. 9 is a flowchart illustrating a print control process according to a second embodiment.

FIG. 9 is a flowchart of print control process that the controller 21 of the printer 2 executes in place of the above-described print control process of FIG. 8. This print control process (FIG. 9) of the second embodiment is obtained by adding process of S202, S207, S210, S213, and S215 to the print control process (FIG. 8) of the first embodiment. The other process (S201, S203 to S206, S208, S209, S211, S212, S214, and S216) are the same as the processing of S101 to S111 of FIG. 8. Thus, in the following description the differences will be mainly explained.

In S202, the controller 21 sets a provisional print direction to the second direction. The provisional print direction set here is a print direction provisionally set as the present print direction and can be changed in processing (S211 or S216) to be described later.

Thereafter, in S207, the controller 21 determines whether the provisional print direction is the first direction. When the controller 21 determines that the provisional print direction is the first direction (S207: Yes), the controller 21 performs the process of S208 (the same process as the gradation value accumulation process of S106 of the first embodiment). On the other hand, when the controller 21 determines that the provisional print direction is not the first direction (that is, when the controller 21 determines that the provisional print direction is the second direction) (S207: No), the controller 21 does not perform process of S208.

Thereafter, in S210, the controller 21 determines whether the provisional print direction is the first direction. When the controller 21 determines that the provisional print direction is the first direction (S210: Yes), the controller 21 performs process of S211 (the same process as the print direction setting process of S108 of the first embodiment). In this print direction setting process of S211, the present print direction is set irrespective of the provisional print direction. That is, the print execution section 26 executes printing operation with the main scanning direction set in S211. On the other hand, when the controller 21 determines that the provisional print direction is not the first direction (i.e., the second direction) (S210: No), the controller 21 does not perform process of S211 and sets the present print direction to the second direction. That is, the print execution section 26 executes printing operation with the main scanning direction of the print head 27 set to the second direction.

Thereafter, in S213, the controller 21 sets the provisional print direction to the direction opposite to the previous print direction. Here, the previous print direction is the print direction determined in the process of S211 if this S211 is performed whereas the previous print direction is the second direction if the process of S211 is not performed. That is, in S213, the controller 21 sets the provisional print direction to the direction realizing the bidirectional printing. The determination of whether the provisional print direction is the first direction or not made in S215 is the same as the process of S210, so description thereof will be omitted.

<2-3. Effect>

As described above, according to the second embodiment, in the case where the provisional print direction set in the process of S202 or S213 is the second direction, the gradation value accumulation processing (S208) and print direction setting process (S211 and S216) are omitted. That is, in the case where the previous main scanning direction is not the second direction (that is, in the case where the previous main scanning direction is the first direction), the present main scanning direction is set to the second direction unconditionally. This is because in the case where the previous print direction is not the second direction (that is, in the case where the previous print direction is the first direction), even if the print direction setting process (S211 or S216) is performed, the present print direction is inevitably set to the second direction irrespective of whether the restriction block is included in target partial image data. Thus, according to the second embodiment, the process amount and time required for the print control process can be reduced as compared to those in the first embodiment.

<Variations>

While the invention has been described in detail with reference to the embodiments thereof, it would be apparent to those skilled in the art that various changes and modifications may be made therein without departing from the scope of the invention.

(1) In the above embodiments, the threshold value for boundary block (that is the threshold value smaller than the threshold value for internal block) is always used for the boundary block. However, the threshold value for internal block may be used for a boundary block for which there is no need or a little need to take the adjacent color difference into consideration. Specifically, for example, the following cases (1A to 1D) can be considered.

(1A) Partial image data printed on the paper sheet P by the first main scan cannot be adjacent to another partial image data at the upper side boundary thereof. Similarly, partial image data printed on the paper sheet P by the last main scan cannot be adjacent to another partial image data at the lower side boundary thereof. That is, among images corresponding to a plurality of boundary blocks in the partial image data printed on the paper sheet P by the first or last main scan, images of boundary blocks on the sub scanning direction end (upper end or lower end) cannot be adjacent to images within another band. Therefore, only the separate color difference need to be taken into consideration for such boundary blocks, while the adjacent color difference need not be taken into consideration therefor. Thus, the threshold value for internal block can be used for such boundary blocks, whereby the main scanning direction is unlikely to be restricted to the second direction as compared to a case where the threshold value for boundary block is used for every boundary block.

(1B) Partial image data to be printed after the blank skipping cannot be adjacent to another partial image data at the upper side boundary thereof. Similarly, partial image data to be subjected to the blank skipping after printing cannot be adjacent to another partial image data at the lower side boundary thereof. That is, among images corresponding to a plurality of boundary blocks in the partial image data adjacent to the blank line data, images of boundary blocks on the side adjacent to the blank line data are not subject to the adjacent color difference but only subject to the separate color difference. Thus, the threshold value for internal block can be used for such boundary blocks, whereby the main scanning direction is unlikely to be restricted to the second direction.

(1C) For images of boundary blocks in one band each having a color different in image data from images of the boundary blocks in another band adjacent to the one band, there is a little need to take the adjacent color difference into consideration. Thus, the threshold value for internal block can be used for such boundary blocks, whereby the main scanning direction is unlikely to be restricted to the second direction, Whether the colors of the images of adjacent boundary blocks are different may be determined based on, e.g., the index value (one or both of the first and second index values) concerning the estimated ink amount to be used in printing (when the index values of the adjacent boundary blocks are different, it may be determined that the colors of images thereof are different).

Figure 10:
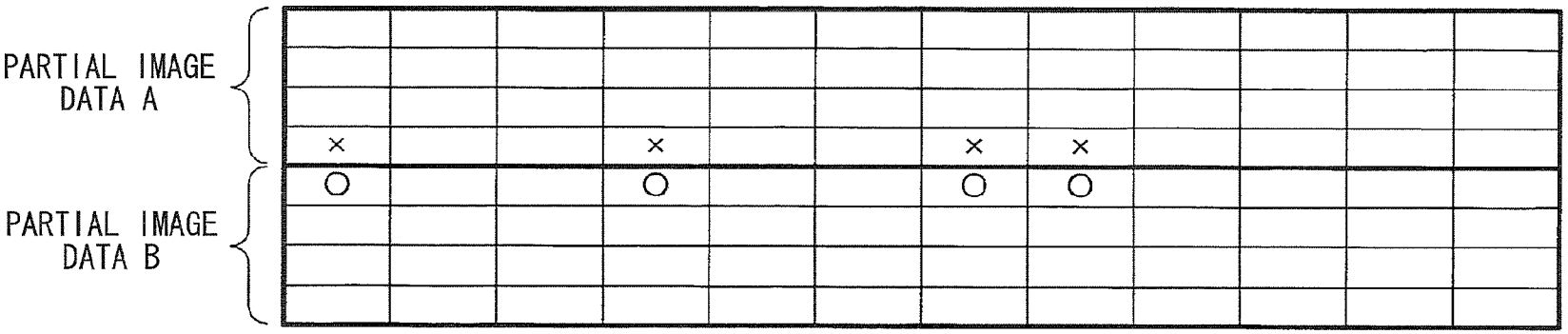
FIG. 10 is an explanatory diagram illustrating a boundary block adjacent to another boundary block that is included in another band and is determined as a restriction block.

(1D) For an image of one boundary block adjacent to another boundary block in a different band which has been determined as not being the restriction block, there is a little need to take the adjacent color difference into consideration. Thus, the threshold value for internal block is be used for such a boundary block. For example, as illustrated in FIG. 10, boundary blocks indicated by "x" included in a plurality of boundary blocks along the lower side boundary in partial image data A printed by the previous main scan are not to be the restriction blocks. In this case, for boundary blocks (boundary blocks indicated by "O") adjacent to the boundary block indicated by "x" included in a plurality of boundary blocks along the upper side boundary (boundary adjacent to the partial image data A) in partial image data B to be printed by the present main scan, the threshold value for internal block is used. Then, the main scanning direction performing printing is unlikely to be restricted to the second direction.

(2) In the above embodiments, the CMY gradation values of all the pixels included in the block are accumulated. However, in place of this, the CMY gradation values of only the pixels in which the second largest gradation value of all the CMY gradation values of each pixel is greater than or equal to a determination criterion value may be accumulated. For example, when the controller 21 determines in the process corresponding to S106 of the above embodiment that the gradation value of the black (K) is greater than or equal to the black determination value, the total sum of the CMY gradation values are added to the count value of the first counter under conditions that the second largest gradation value of all the CMY gradation values of the pixel to be processed is greater than or equal to the determination criterion value. For example, the determination criterion value is set to 40. When the gradation values of the pixel are (C, M, Y, K)=(100, 50, 0, 0), which indicates that the gradation value of the magenta (M) is greater than or equal to the determination criterion value, so the gradation values of the CMY are accumulated. On the other hand, when the gradation values of the pixel are (C, M, Y, K)=(100, 30, 0, 0), which indicates that the gradation value of the magenta (M) is smaller than the determination criterion value, so the gradation values of the CMY are not accumulated. With this configuration, a pixel containing a single color ink or a pixel containing substantially a single color ink (pixel with no overlapping of ink or a little overlapping of ink) can be excluded from the accumulation target group, allowing more appropriate determination of whether the difference in color development of a printed image.

(3) In the above embodiments, the index value concerning the estimated ink amount to be used in printing is calculated for each block in the 256-gradation level image data that has not been subjected to the halftone process based on the accumulation value of the gradation values of each of a plurality of pixels in the block. However, the present invention is not limited to this. For example, the index value may be calculated for each block in the four-gradation print data that has been subjected to the halftone process (S12) based on the accumulation value of the gradation values of each of a plurality of pixels in the block. When the four gradation values (dot sizes) are converted into ink droplet amounts (e.g., large dot: 16 pl, medium dot: 5 pl, small dot: 3 pl) to be used in dot formation, and the ink droplet amounts are used in the above accumulation, the estimated ink amount can be reflected in the index value more accurately.

Figure 11:
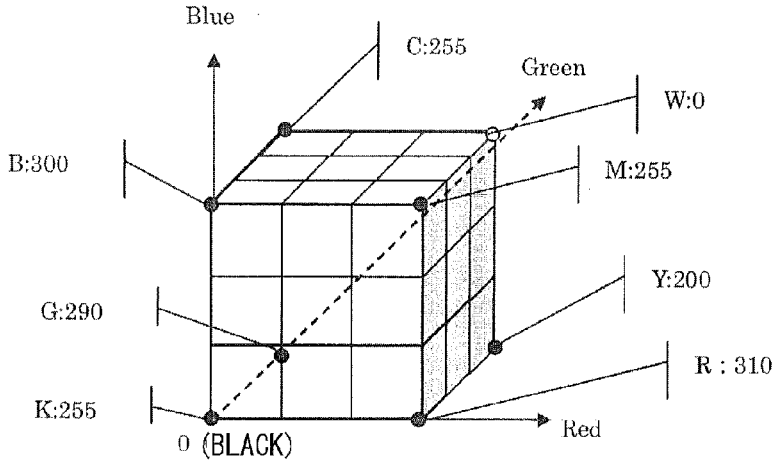
FIG. 11 is an explanatory diagram illustrating a lookup table specifying a correspondence relation ship between RGB values and weighted coefficients.

(4) The weight of the value to be accumulated may be changed depending on the ink type or ink combination by referring to a numerical expression or a lookup table. For example, the color difference in the yellow (Y) ink or light ink such as light cyan or light magenta (which is not used in the embodiments) due to the ink overlapping order is less noticeable, so that the weight thereof may be made smaller than other inks (e.g., reduced to 66%) in the accumulation. Further, weighted coefficients may be set by the lookup table as shown in, e.g., FIG. 11 for accumulation depending on the ink combination. A lookup table of FIG. 11 specifies a correspondence relationship between RGB values (pixel value before color conversion process) and weighted coefficient (in this example, 255 is set to 100%). Specifically, the weighted coefficients are set to lattice points corresponding to eight vertices indicating the maximum and minimum values of each of RGB directions in an RGB color space, and weighted coefficient corresponding to RGB values other than those at the lattice points is calculated by interpolation using the weighted coefficients at the lattice points. For example, a point R is a point at which the red is the maximum value, and thus the magenta and yellow inks are heavily used. Accordingly, the color difference in the area around the point R due to ink overlapping order is easily noticeable. So, the weighted coefficient thereof is set to the maximum value (310). On the other hand, a point W is a point at which no ink is used, and thus the color difference in the area around the point W due to ink overlapping order is less noticeable. So, the weighted coefficient thereof is set to 0. For other lattice points, the weighted coefficients are set depending on whether the color difference according to the ink overlapping order is noticeable or not.

Figure 12:
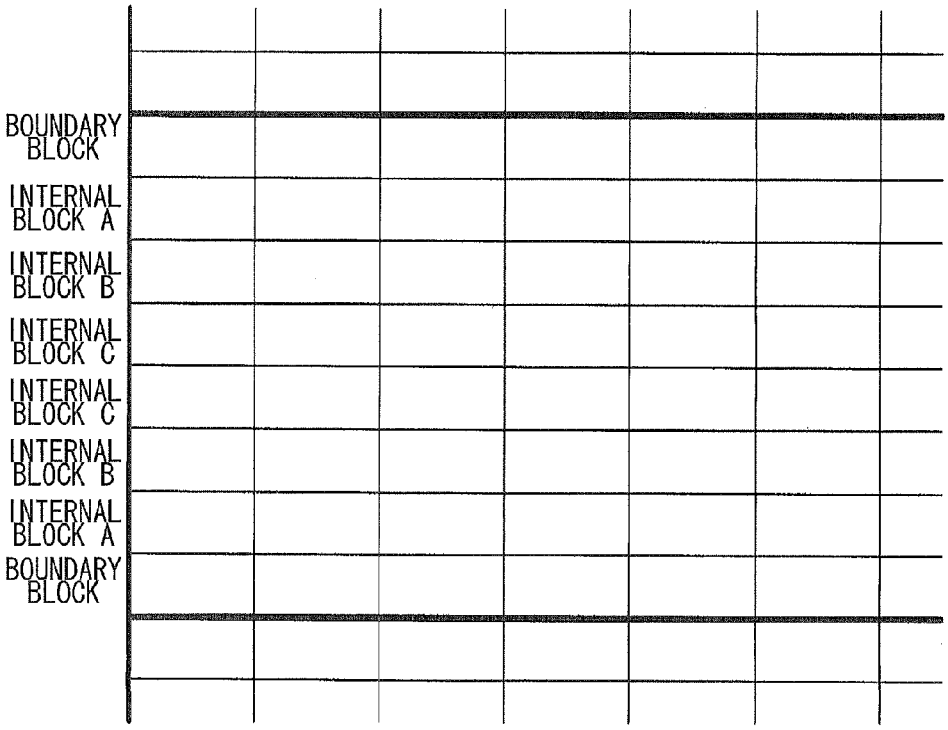
FIG. 12 is an explanatory diagram illustrating partial image data in which internal blocks are classified into a plurality of types.

(5) In the above embodiments, the plurality of blocks in the partial image data are classified into two type: the internal block and the boundary block, and the two threshold values for internal block and boundary block are used. An image of an internal block comparatively away from the boundary of the partial image data is further less noticeable in terms of the separate color difference than an image of an internal block comparatively close to the boundary of the partial image data due to easiness of isolation from an image of a different band. In view of this, the internal blocks are further classified into a plurality of types, and threshold values according to the types are used. Specifically, as shown in e.g., FIG. 12, in the case where the partial image data is divided in the sub scanning direction into eight blocks, six internal blocks exist in the sub scanning direction. The six internal blocks are classified into the following three blocks: internal block A closest to the boundary of the partial image data; internal block B more away from the boundary of the partial image data than the internal block A; and internal block C more away from the boundary of the partial image data than the internal block B. That is, the three internal blocks A, B and C are arranged in this order from the boundary. Then, different threshold values are used for the three internal blocks A, B, and C, respectively. Specifically, the threshold values are set so as to establish the following relationship: threshold value for internal block A<threshold value for internal block B<threshold value for internal block C. As a result, the internal block more away from the boundary is unlikely to be determined as the restriction block. Thus, the main scanning direction performing printing is unlikely to be restricted to the second direction as compared to a case where a determination of whether the internal block is the restriction block or not is made according to the same criterion (same threshold value).

(6) In the above embodiments, the index values (first index value and second index value) concerning the estimated ink amount to be used in printing are used according to a common calculation criterion between the boundary block and internal block, and the threshold value for internal block is set to a value larger than the threshold value for boundary block. However, the present invention is not limited to this. That is, a configuration may only have to satisfy the followings: when the index value of a boundary block indicates that the estimated ink amount thereof is larger than first amount, the boundary block can be determined as the restriction block; and when the index value of an internal block indicates that the estimated ink amount thereof is larger than second amount (second amount>first amount), the internal block can be determined as the restriction block. For example, the index value may be calculated according to different calculation criteria between the boundary block and internal block in such a way that the index value of the boundary block is set to a value larger than the index value of the internal block.

(7) In the above embodiments, the partial image data is divided vertically and horizontally into a plurality of blocks. However, in place of this, the position of the block (target area for which the index value is to be calculated) may be sequentially shifted by the shift amount (e.g., by one pixel) smaller than the block width. That is, in the above embodiments, the pixel in the partial image data belongs to only one of the plurality of blocks. However, when the block is sequentially shifted, the pixel changes its position and thus can belong to the plurality of blocks located at different positions. This configuration prevents the following case where even though the partial image data includes an object easily noticeable (the amount of the ink to be used for the object is large) in terms of color development of a printed image, the individual blocks are unlikely to be determined as the restriction block because the object is divided into a plurality of blocks.

(8) In the above embodiments, for the partial image data including the restriction block, the main scanning direction is set to a specified direction (second direction in the embodiment) irrespective of the previous main scanning direction. However, in place of this, the main scanning direction for the partial image data including the restriction block may be set to the same direction as the previous main scanning direction.

(9) In the above embodiments, the print control process is executed on the printer 2 side. However, the present invention is not limited to this, but the print control process may be executed on the personal computer 1 (printer driver 123) side.

Figure 7:
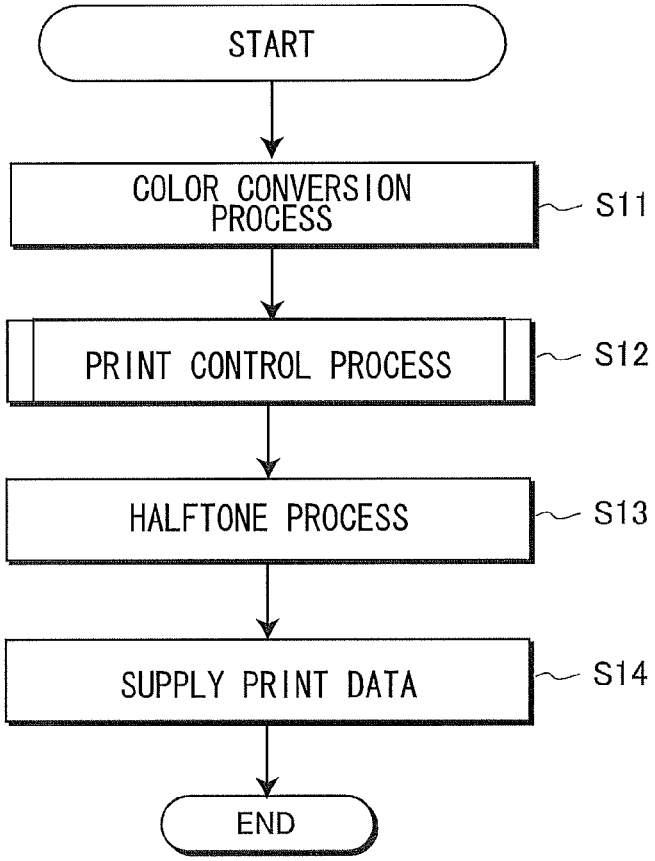
FIG. 7 is a flowchart of a process executed by a printer.

(10) At least part of processes shown in FIGS. 7, 8, and 9 may be performed a specific hardware, such as ASIC.

What is claimed is:

1. A print control device comprising:

a processor configured to control a print execution unit to print an image on a recording sheet while performing a main scanning in which a print head moves in one of a first main scanning direction and a second main scanning direction opposite to the first main scanning direction, wherein the print head ejects ink droplets of a plurality of colors to overlap one on the other in a first order on the recording sheet while performing the main scanning in which the print head moves in the first direction, whereas the print head ejects ink droplets of the plurality of colors to overlap one on the other in a second order different from the first order on the recording sheet while performing the main scanning in which the print head moves in the second main scanning direction, wherein the processor is configured to operate as:

a block setting unit configured to set a plurality of blocks for each of a plurality of part data included in image data, each part data corresponding to a unit region on a recording sheet, the unit region to be printed while the main scanning is performed once, each block including a plurality of pixels, and the image data including a gradation value for each pixel selected from a first group of gradation levels;

a halftone process unit configured to perform a halftone process in which the gradation value for each pixel is converted into a converted gradation value representing such pixel and determined from a second group of gradation levels, the second group of gradation levels including fewer gradation levels than the first group of gradation levels;

a determining unit configured to calculate an index value for each block in the image data targeted for printing using the gradation value for at least one pixel in such block before performing the halftone process on the gradation value for the at least one pixel in such block, wherein the index value for each block corresponds to an estimated amount of ink that is to be used to print such block, and wherein the determining unit is further configured to determine, for each block included in the part data, whether a specific condition, for printing the part data including such block in a specific direction, is satisfied based on the index value of such block; and a direction setting unit configured to set, for each part data, a direction of the main scanning to the specific direction, irrespective of a previously set direction of main scanning, when it is determined that the part data includes at least one block that satisfies the specific condition, whereas the direction setting unit is configured to set the direction of the main scanning to an opposite direction opposite to the previously set direction of main scanning when it is determined that the part data does not include at least one block that satisfies the specific condition, wherein the plurality of blocks includes a boundary block representing an image portion located adjacent to a boundary of the unit region and an internal block representing an image portion located apart from the boundary of the unit region;

wherein the determining unit is configured to determine that the specific condition is satisfied for the boundary block when the index value of the boundary block indicates that the estimated amount is larger than a first value;

wherein the determining unit is configured to determine that the specific condition is satisfied for the internal block when the index value of the internal block indicates that the estimated amount is larger than a second value, the second value being larger than the first value; and wherein the print execution unit is configured to print the image on the recording sheet by controlling the print head to eject the ink droplets based on the converted gradation values representing the plurality of pixels included in each block.

2. The print control device according to claim 1, wherein the determining unit is configured to determine that the specific condition is satisfied for the boundary block when the index value of the boundary block is larger than a first threshold value; and wherein the determining unit is configured to determine that the specific condition is satisfied for the internal block when the index value of the internal block is larger than a second threshold value that is larger than the first threshold value.

3. The print control device according to claim 1, wherein the specific direction is one of the first main scanning direction and the second main scanning direction.

4. The print control device according to claim 3, wherein when the direction of the main scanning that is previously set does not conform with the specific direction, the determining unit does not perform a determination of whether the specific condition is satisfied for the plurality of blocks in the part data, and the direction setting unit sets the main scanning direction to the specific direction.

5. The print control device according to claim 1, wherein the plurality of blocks include a plurality of internal blocks, the plurality of internal blocks including a first-type internal block and a second-type internal block representing an image located apart from the boundary of the unit region than the first-type internal block, wherein the determining unit is configured to determine that the specific condition is satisfied for the first-type internal block when the index value of the first-type internal block indicates that the estimated amount is larger than a first-type second value; and wherein the determining unit is configured to determine that the specific condition is satisfied for the second-type internal block when the index value of the internal block of the second-type internal block indicates that the estimated amount is larger than a second-type second value, the second-type second value being is larger than the first-type second value.

6. The print control device according to claim 1, wherein the boundary block includes a first-type boundary block included in the part data printed on the recording sheet while the main scanning is performed firstly or lastly, the first-type boundary block representing an image located at a side corresponding to an end of the image printed on the recording sheet; and wherein the determining unit is configured to determine that the specific condition is satisfied for the first-type boundary block when the index value of the first-type boundary block indicates that the estimated amount is larger than the second value.

7. The print control device according to claim 1, wherein the part data includes line data corresponding to at least one line in which all the pixels indicate white pixels, each line extending in the main scanning direction in the unit region, wherein the boundary block includes a second-type boundary block representing an image adjacent to the at least one line;

wherein the processor is configured to control the print execution unit to skip printing a part of the image corresponding to the at least one line; and wherein the determining unit is configured to determine that the specific condition is satisfied for the second-type boundary block when the index value of the second-type boundary block indicates that the estimated amount is larger than the second value.

8. The print control device according to claim 1, wherein the boundary block includes a third-type boundary block representing an image adjacent to an image represented by a specific boundary block which is included in the part data printed by the previous main scanning and in which color to be printed is different from color to be printed in the third-type boundary block; and wherein the determining unit is configured to determine that the specific condition is satisfied for a third-type boundary block when the index value of the third-type boundary block indicates that the estimated amount is larger than the second value.

9. The print control device according to claim 1, wherein the boundary block includes a fourth-type boundary block representing an image adjacent to an image represented by a boundary block which is included in the part data printed by the previous main scanning and for which the determining unit determines that the specific condition is not satisfied; and wherein the determining unit is configured to determine that the specific condition is satisfied for the fourth-type boundary block when the index value of the fourth-type boundary block indicates that the estimated amount is larger than the second value.

10. The print control device according to claim 1, wherein the gradation values for the plurality of pixels included in each block include gradation values corresponding to ink of a chromatic color; and wherein the determining unit is configured to calculate the index value for each block by using the gradation values corresponding to the ink of the chromatic color for the plurality of pixels included in such block.

11. The print control device according to claim 10, wherein the gradation values for the plurality of pixels included in each block include a plurality of gradation values for each pixel of the plurality of pixels included in such block, and the plurality of gradation values for such pixel includes gradation values corresponding to ink of a plurality of chromatic colors; and wherein the determining unit is configured to calculate the index value for each block by using at least one gradation value that is a second largest gradation value among the plurality of gradation values for one pixel in such block when the second largest gradation value is greater than a prescribed value.

12. The print control device according to claim 10, wherein the gradation values for the plurality of pixels included in each block include a plurality of gradation values for each pixel of the plurality of pixels included in such block, and the plurality of gradation values for such pixel includes a gradation value corresponding to ink of a chromatic color and a gradation value corresponding to ink of an achromatic color;

wherein the determining unit is configured to calculate a first index value by using gradation values for the plurality of pixels in the block and a second index value by using gradation values for at least one pixel whose gradation value corresponding to ink of the achromatic color greater than a prescribed value;

wherein the determining unit is configured to determine, as the specific condition, whether the first index value satisfies a first specific condition and whether the second index value satisfies a second specific condition; and wherein, when it is determined that the part data includes a block having at least one of the first index value satisfying the first specific condition and the second index value satisfying the second specific condition, the direction setting unit is configured to set the direction of the main scanning to the specific direction irrespective of the previously set direction of main scanning, whereas, when it is determined that the part data does not include the block having at least one of the first index value satisfying the first specific condition and the second index value satisfying the second specific condition, the direction setting unit is configured to set the direction of the main scanning to the opposite direction.

13. The print control device according to claim 1, wherein the gradation values for the plurality of pixels included in the image data include a first-type gradation value and a second-type gradation value, the first-type gradation value corresponding to ink of a first color and the second-type gradation value corresponding to ink of a second color; and wherein the determining unit is configured to calculate the index value such that, in a case where the first-type gradation value is equal to the second-type gradation value, the index value calculated by using the first-type gradation value is larger than the index value calculated by using the second-type gradation value.

14. The print control device according to claim 1, wherein the gradation values for the plurality of pixels included in the image data include a first-type gradation value and a second-type gradation value, the first-type gradation value corresponding to ink of a first color and the second-type gradation value corresponding to ink of a second color; and wherein the determining unit is configured to calculate the index value by using the first-type gradation value and the second-type gradation value with different weights.

15. A non-transitory computer readable storage medium storing computer-readable instructions thereon, which, when executed by a processor, instruct the processor to perform processes comprising:

controlling a print execution unit to print an image on a recording sheet while performing a main scanning in which a print head moves in one of a first main scanning direction and a second main scanning direction opposite to the first main scanning direction, wherein the print head ejects ink droplets of a plurality of colors to overlap one on the other in a first order on the recording sheet while performing the main scanning in which the print head moves in the first direction, whereas the print head ejects ink droplets of the plurality of colors to overlap one on the other in a second order different from the first order on the recording sheet while performing the main scanning in which the print head moves in the second main scanning direction, setting a plurality of blocks for each of a plurality of part data included in image data, each part data corresponding to a unit region on a recording sheet, the unit region to be printed while the main scanning is performed once, each block including a plurality of pixels, and the image data including a gradation value for each pixel selected from a first group of gradation levels;

performing a halftone process in which the gradation value for each pixel is converted into a converted gradation value representing such pixel and determined from a second group of gradation levels, the second group of gradation levels including fewer gradation levels than the first group of gradation levels;

calculating an index value for each block in the image data targeted for printing using the gradation value for at least one pixel in such block before performing the halftone process on the gradation value for the at least one pixel in such block, wherein the index value for each block corresponds to an estimated amount of ink that is to be used to print such block, determining, for each block included in the part data, whether a specific condition, for printing the part data including such block in a specific direction, is satisfied based on the index value of such block;

setting, for each part data, a direction of the main scanning to the specific direction, irrespective of a previously set direction of main scanning, when it is determined that the part data includes at least one block that satisfies the specific condition, whereas the setting includes setting the direction of the main scanning to an opposite direction opposite to the previously set direction of the main scanning when it is determined that the part data does not include at least one block that satisfies the specific condition, wherein the plurality of blocks includes a boundary block representing an image portion located adjacent a boundary of the unit region and an internal block representing an image portion located apart from the boundary of the unit region;

wherein the specific condition is determined to be satisfied for the boundary block when the index value of the boundary block indicates that the estimated amount is larger than a first value;

wherein the specific condition is determined to be satisfied for the internal block when the index value of the internal block indicates that the estimated amount is larger than a second value, the second value being larger than the first value; and wherein controlling the print execution unit to print the image on a recording sheet includes controlling the print head to eject the ink droplets based on the converted gradation values representing the plurality of pixels included in each block.

16. A print control device comprising:

a processor configured to control a print execution unit to print an image on a recording sheet while performing a main scanning in which a print head moves in one of a first main scanning direction and a second main scanning direction opposite to the first main scanning direction, wherein the print head ejects ink droplets of a plurality of colors to overlap one on the other in a first order on the recording sheet while performing the main scanning in which the print head moves in the first direction, whereas the print head ejects ink droplets of the plurality of colors to overlap one on the other in a second order different from the first order on the recording sheet while performing the main scanning in which the print head moves in the second main scanning direction, wherein the processor is configured to operate as:

a block setting unit configured to set a plurality of blocks for each of a plurality of part data included in image data, each part data corresponding to a unit region on a recording sheet, the unit region to be printed while the main scanning is performed once, each block including a plurality of pixels;

a determining unit configured to determine, for each block included in the part data, whether a specific condition for printing the part data including the each block in a specific direction is satisfied based on an index value of the each block relating to an estimated amount of ink that is to be used; and a direction setting unit configured to set, for each part data, a direction of the main scanning to the specific direction, irrespective of a previously set direction of main scanning, when it is determined that the part data includes at least one block that satisfies the specific condition, whereas the direction setting unit is configured to set the direction of the main scanning to an opposite direction opposite to the previously set direction of main scanning when it is determined that the part data does not include at least one block that satisfies the specific condition, wherein the plurality of blocks includes a boundary block representing an image portion located adjacent to a boundary of the unit region and an internal block representing an image portion located apart from the boundary of the unit region;

wherein the determining unit is configured to determine that the specific condition is satisfied for the boundary block when the index value of the boundary block indicates that the estimated amount is larger than a first value;

wherein the determining unit is configured to determine that the specific condition is satisfied for the internal block when the index value of the internal block indicates that the estimated amount is larger than a second value, the second value being larger than the first value;

wherein the image data includes a gradation value falling within a first number of grades;

wherein the processor is configured to further operate as a halftone process unit configured to perform a halftone process in which the gradation value is converted into a processed gradation value falling within a second number of grades, the second number being smaller than the first number, the print head being capable of expressing the second number of grades;

wherein the determining unit configured to calculate, for each block in the image data targeted for printing, the index value by using the gradation value in the each block before performing the halftone process;

wherein the image data includes gradation values corresponding to ink of a chromatic color for the plurality of pixels;

wherein the determining unit is configured to calculate the index value by using the gradation values corresponding to achromatic color of ink for each of the plurality of pixels;

wherein the image data includes, for each of the plurality of pixels in the block, a gradation value corresponding to ink of a chromatic color and a gradation value corresponding to ink of an achromatic color;

wherein the determining unit is configured to calculate a first index value by using gradation values for the plurality of pixels in the block and a second index value by using gradation values for at least one pixel whose gradation value corresponding to ink of the achromatic color greater than a prescribed value;

wherein the determining unit is configured to determine, as the specific condition, whether the first index value satisfies a first specific condition and whether the second index value satisfies a second specific condition; and wherein, when it is determined that the part data includes a block having at least one of the first index value satisfying the first specific condition and the second index value satisfying the second specific condition, the direction setting unit is configured to set the direction of the main scanning to the specific direction, whereas, when it is determined that the part data does not include the block having at least one of the first index value satisfying the first specific condition and the second index value satisfying the second specific condition, the direction setting unit is configured to set the direction of the main scanning to the opposite direction.

17. The print control device according to claim 1, wherein the first group of gradation levels includes only 256 gradation levels and the second group of gradation levels includes only 4 gradation levels.

* * * * *